US009328435B2

(12) United States Patent
Yun

(10) Patent No.: US 9,328,435 B2
(45) Date of Patent: May 3, 2016

(54) FUNCTIONAL WEAVING VAMP FABRIC

(71) Applicant: DEERTEX, INC., Changhua (TW)

(72) Inventor: Ching-Ting Yun, Taichung (TW)

(73) Assignee: DEERTEX, INC., Changhua (TW)

( * ) Notice: Subject to any disclaimer, the term of this patent is extended or adjusted under 35 U.S.C. 154(b) by 0 days.

(21) Appl. No.: 14/474,748

(22) Filed: Sep. 2, 2014

(65) Prior Publication Data

US 2015/0129078 A1 May 14, 2015

(30) Foreign Application Priority Data

| | | |
|---|---|---|
| Nov. 8, 2013 | (TW) | 102220879 U |
| Jan. 29, 2014 | (TW) | 103201937 U |
| May 20, 2014 | (TW) | 103208767 U |

(51) Int. Cl.

| | |
|---|---|
| ***D03D 3/02*** | (2006.01) |
| ***D03D 13/00*** | (2006.01) |
| ***D03D 1/00*** | (2006.01) |
| ***D03C 3/40*** | (2006.01) |
| ***D03D 15/00*** | (2006.01) |
| ***D03D 15/08*** | (2006.01) |
| ***A43B 1/04*** | (2006.01) |
| ***A43B 23/02*** | (2006.01) |

(52) U.S. Cl.

CPC .. *D03D 1/00* (2013.01); *A43B 1/04* (2013.01); *A43B 23/0245* (2013.01); *D03C 3/40* (2013.01); *D03D 13/002* (2013.01); *D03D 13/004* (2013.01); *D03D 15/0094* (2013.01); *D03D 15/08* (2013.01); *D10B 2501/043* (2013.01)

(58) Field of Classification Search

CPC ..... D03C 9/02; D03C 9/024; D03C 3/20; D03C 19/00; D03C 19/005; D03C 7/06; D03C 9/06; D03C 9/0608; D03C 7/00; D03D 41/00; D03D 13/004; D03D 13/002; D03D 47/38; D03D 49/12; D03D 23/00

See application file for complete search history.

(56) References Cited

U.S. PATENT DOCUMENTS

| | | | | |
|---|---|---|---|---|
| 3,556,165 | A * | 1/1971 | Jisa | D03D 23/00 139/383 R |
| 3,590,880 | A * | 7/1971 | Kathriner | D03C 9/02 139/192 |
| 6,213,162 | B1 * | 4/2001 | Baechtold | B41F 45/08 139/93 |
| 6,311,737 | B2 * | 11/2001 | Wahhoud | D03C 7/00 139/50 |
| 7,281,548 | B2 * | 10/2007 | Schmid | D03C 9/02 139/93 |

(Continued)

*Primary Examiner* — Bobby Muromoto, Jr.

(74) *Attorney, Agent, or Firm* — Muncy, Geissler, Olds & Lowe, P.C.

(57) ABSTRACT

A functional weaving vamp fabric is disclosed, which is formed by a two beams jacquard according to a texture composition. The two beams jacquard comprises two warp beams, a jacquard and a plurality of weft knitting mechanisms, characterized in: the warp group having a plurality of first warp units and a plurality of second wrap units, the two warp beams yarn feed roller groups respectively delivering the plurality of first warp units and the plurality of second wrap units, the weft group having a plurality of weft units, and respectively delivering the plurality of corresponding weft units; wherein the jacquard interlaces the warp group and the weft group according to the texture composition, and using diversity of yarn materials or thread diameters of the plurality of first warp units and the plurality of second wrap units to produce the functional weaving vamp fabric in the process of single weaving.

10 Claims, 4 Drawing Sheets

(56) References Cited

U.S. PATENT DOCUMENTS

| | | | | |
|---|---|---|---|---|
| 8,733,406 | B2 * | 5/2014 | Hannes | D03C 7/06 139/1 R |
| 8,800,606 | B2 * | 8/2014 | Cross | D03J 1/00 139/116.1 |
| 2001/0013377 | A1 * | 8/2001 | Wahhoud | D03C 7/00 139/54 |
| 2006/0011252 | A1 * | 1/2006 | Schmid | D03C 9/02 139/93 |
| 2007/0084518 | A1 * | 4/2007 | Himmelstoss | D03C 9/02 139/11 |
| 2008/0083471 | A1 * | 4/2008 | Mettler | D03C 9/024 139/93 |
| 2010/0084040 | A1 * | 4/2010 | Stauss | D03C 9/02 139/93 |
| 2013/0186505 | A1 * | 7/2013 | Cross | D03J 1/00 139/11 |
| 2013/0186506 | A1 * | 7/2013 | Cross | D06B 1/00 139/68 |
| 2013/0189890 | A1 * | 7/2013 | Cross | D06B 1/00 442/200 |
| 2015/0308020 | A1 * | 10/2015 | Gerth | D03C 9/02 139/94 |

* cited by examiner

FUNCTIONAL WEAVING VAMP FABRIC

CROSS-REFERENCE TO RELATED APPLICATION

This application claims priority from Taiwan Patent Application No. 102220879, filed on Nov. 8, 2013, No. 103201937, filed on Jan. 29, 2014, and No. 103208767, filed on May 20, 2014 in the Taiwan Intellectual Property Office, the content of which are hereby incorporated by reference in their entirety for all purposes.

BACKGROUND OF THE INVENTION

1. Field of the Invention

The present invention discloses a weaving vamp fabric using two warp beam yarn feed rollers of two beams jacquard to deliver warp and weft groups with different types of yarns or thread diameters to interlace fabric's inner and outer structures to form a functional weaving vamp fabric.

2. Description of the Related Art

With burgeoning development of high technology, the textile industry, which belongs to one of traditional industries, is encountering tremendous competition and pressure of industrial transformation, so it has to keep promoting and integrating the textile technique to develop high value-added products; moreover, apart from beautiful appearance, the textile products are requested for various kinds of comfort and protectiveness in recent year. As a result, functional woven fabrics have become popular merchantable goods in the textile industry.

The traditional weaving machines merely use single warp beam yarn feed roller to deliver warp yarn with single type or thread diameter, resulting that only single layer fabric is produced; provided that it desires to produce double-layered fabric with different materials, weaving two pieces of single layer fabrics or conducting two manufacturing processes to single layer fabric is necessitated; however, it is time-consuming, and the yield rate can't be controlled accurately.

In view of the aforementioned description, inventor of the present invention has mulled it over and therefore designs a functional weaving vamp fabric which aims to improve the shortcomings of the current technique so as to increase the industrial practicability.

SUMMARY OF THE INVENTION

In view of the technical problem of prior art, purpose of the present invention is to provide a functional weaving vamp fabric which uses weaving technique to directly weave the fabric as a vamp fabric, and respectively deliver a first warp unit and a second warp unit with different yarn types or thread diameters, and to interlace as a function weaving vamp fabric so as to decrease time and procedures in stitching pieces of vamp.

In view of the technical problem of prior art, purpose of the present invention is to provide a functional weaving vamp fabric. Because the fabrics, which are applied to shoes, structure of its outer layer needs to have sufficient wear-resistant to avoid damage from rubbing, and as the inner structure and user's feet contact with each other that leads to the higher demand for touching; furthermore, way of interlacing warp and weft yarns limits that the traditional weaving machine is incapable of weaving fabrics with diverse thickness and different inner and outer structures in single manufacturing process.

In view of the technical problem of prior art, purpose of the present invention is to provide a weaving vamp fabric having wear-resistant function formed by a two beams jacquard according to a texture composition, the two beams jacquard comprising two warp beam yarn feed rollers, a jacquard and a plurality of weft knitting mechanisms, and the fabric comprising: a warp group having a plurality of first warp units and a plurality of second warp units, the two warp beams yarn feed rollers respectively delivering the plurality of first warp units and the plurality of second warp units, and the plurality of first warp units and the plurality of second warp units respectively comprising different yarn types or thread diameters; a weft group having a plurality of weft units, and the plurality of weft units respectively delivering the plurality of corresponding weft units.

Wherein, the jacquard may interlace the warp group and the weft group according to the texture composition, and the fabric may be produced by diversity of yarn materials or thread diameters of the plurality of first warp units and the plurality of second warp units in the process of single weaving.

Preferably, yarn types of the warp group and the weft group may comprise monofilament yarn, elastic fiber yarn, twist yarn or combination thereof.

Preferably, when the yarn type is monofilament yarn, thread diameter of the plurality of first warp units may be from 100 denier to 450 denier, thread diameter of the plurality of second warp units may be from 50 denier to 150 denier, and thread diameter of the plurality of weft units may be 50 denier to 450 denier.

Preferably, when the yarn type is elastic fiber yarn, thread diameter of the plurality of first warp units may be from 300 denier to 1200 denier, thread diameter of the plurality of second warp units may be from 100 denier to 450 denier, and thread diameter of the plurality of weft units may be 100 denier to 1200 denier.

Preferably, when the yarn type is twist yarn, thread diameter of the plurality of first warp units may be from 300 denier to 1200 denier, thread diameter of the plurality of second wrap units may be from 100 denier to 450 denier, and thread diameter of the plurality of weft units may be 100 denier to 1200 denier.

According to the preceding purpose, the present invention may further provide a wear-resistant weaving vamp fabric having ventilation function formed by a two beams jacquard according to a texture composition, wherein the two beams jacquard may comprise two warp beam yarn feed rollers, a jacquard, a plurality of triangle heddle elements and a plurality of weft knitting mechanisms, the texture composition may comprise a pore layout, and the fabric may comprise: a warp group having a plurality of first warp units and a plurality of second warp units, the two warp beams yarn feed rollers respectively delivering the plurality of first warp units and the plurality of second warp units, and the plurality of first warp units and the plurality of second warp units respectively comprising different yarn types or thread diameters; a weft group having a plurality of weft units, and the plurality of weft units respectively delivering the plurality of corresponding weft units;

Wherein, the plurality of triangle heddle elements and the jacquard may enable the plurality of corresponding first warp units and the plurality of second warp units lifting or shifting oppositely according to the pore layout, and may collocate with the warp group to interlace obliquely to form a plurality of ventilating pores, and the fabric may be produced by diversity of yarn materials or thread diameters of the plurality of first warp units and the plurality of second warp units in the process of single weaving.

Preferably, yarn types of the warp group and the weft group may comprise monofilament yarn, elastic fiber yarn, twist yarn or combination thereof.

Preferably, when the yarn type is monofilament yarn, thread diameter of the plurality of first warp units may be from 100 denier to 450 denier, thread diameter of the plurality of second warp units may be from 50 denier to 150 denier, and thread diameter of the plurality of weft units may be 50 denier to 450 denier.

Preferably, when the yarn type is elastic fiber yarn, thread diameter of the plurality of first warp units may be from 300 denier to 1200 denier, thread diameter of the plurality of second warp units may be from 100 denier to 450 denier, and thread diameter of the plurality of weft units may be 100 denier to 1200 denier.

Preferably, when the yarn type is twist yarn, thread diameter of the plurality of first warp units may be from 300 denier to 1200 denier, thread diameter of the plurality of second warp units may be from 100 denier to 450 denier, and thread diameter of the plurality of weft units may be 100 denier to 1200 denier.

The primary purpose of the present invention is to provide a functional weaving vamp fabric which may have one or more following advantages:

1. Three-dimensional composition: interlacing warp and weft groups having different yarn types and thread diameters to enable the weaving ramp fabric having diverse thickness and three-dimensional composition, and using yarn with thinner thread diameter to make complicated composition.

2. Better wear-resistant: using thread diameter of diverse yarns to conduct weaving collocation according to layout of texture composition, and using yarns with thicker thread diameter to provide better strength of wear-resistant so as to promote fabric's wear-resistant.

3. Diversity of touch: collocating warp and weft groups having different thread diameters with layout of texture composition to weave fabric textile with different inner and outer layers touch.

Hereinafter, embodiments of the present invention will be described in detail with reference to the accompanying drawings so that those skilled in the art to which the present invention pertains can realize the present invention.

DETAILED DESCRIPTION OF THE PREFERRED EMBODIMENTS

Hereinafter, embodiments of the present invention will be described in detail with reference to the accompanying drawings so that those skilled in the art to which the present invention pertains can realize the present invention. As those skilled in the art would realize, the described embodiments may be modified in various different ways, all without departing from the spirit or scope of the present invention.

The exemplary embodiments of the present invention will be understood more fully from the detailed description given below and from the accompanying drawings of various embodiments of the invention, which; however, should not be taken to limit the invention to the specific embodiments, but are for explanation and understanding only.

A functional weaving vamp fabric disclosed in the present invention is to use two beams jacquard to make production according the necessary texture composition, and jacquard pattern, imagery totem or logo and so on can further be decorated therein; wherein the two beams jacquard comprises two warp beam yarn feed rollers, a jacquard and a plurality of weft knitting mechanisms, and the two warp beam yarn feed rollers are used to respectively provide and deliver a plurality of warp units, and deliver a plurality of weft units to conduct interlacing by collocating with the plurality of weft knitting mechanisms; consequently, different types or colors of weaving vamp fabric can be produced by combination of different types or thread diameters of yarns. In practice, all the yarns used in the present invention can be enhanced its tensile strength and wear-resistant by strengthening processes of throwing or mucilage and so on.

After being modeled by a two beams jacquard, a functional weaving vamp fabric of the present invention is divided based on pattern of vamp, and is assembled as shoes product with shoe sole and related elements. Using single weaving process can model the functional vamp fabric, as well as is able to effectively shorten the necessary processing duration and cost of the follow-up process.

Embodiment 1

A Functional Weaving Vamp Fabric with Wear-Resistant

Figure 1:
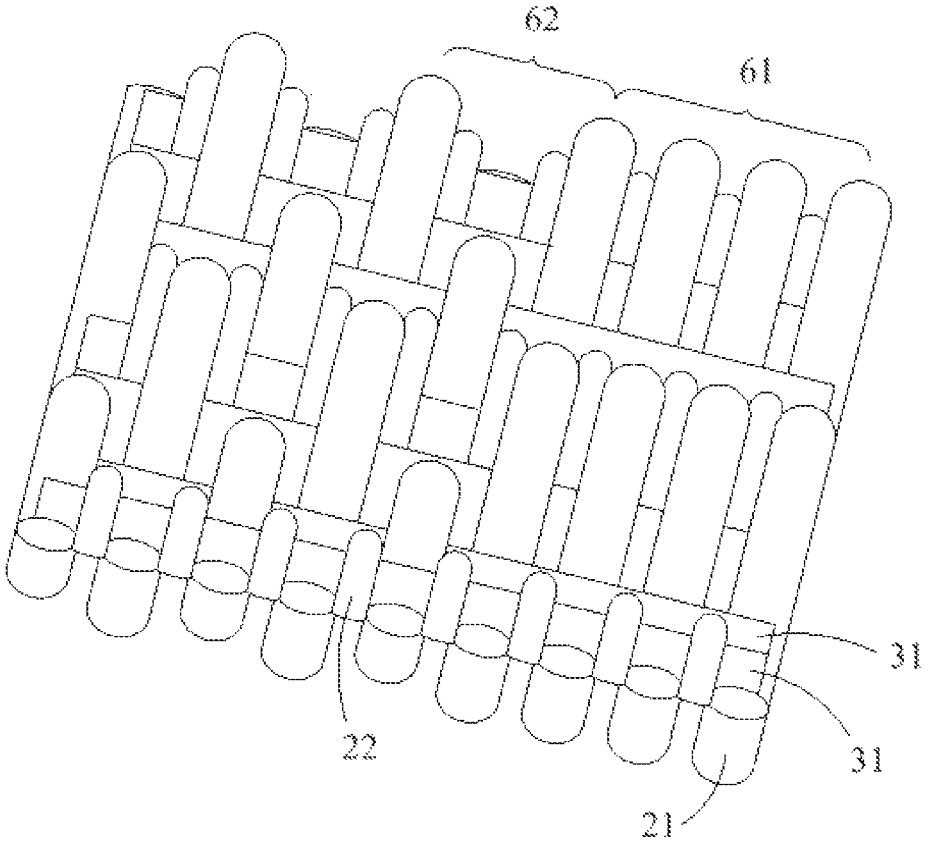
FIG. 1 is a local structural schematic diagram of a functional weaving vamp fabric of the present invention.
Figure 2:
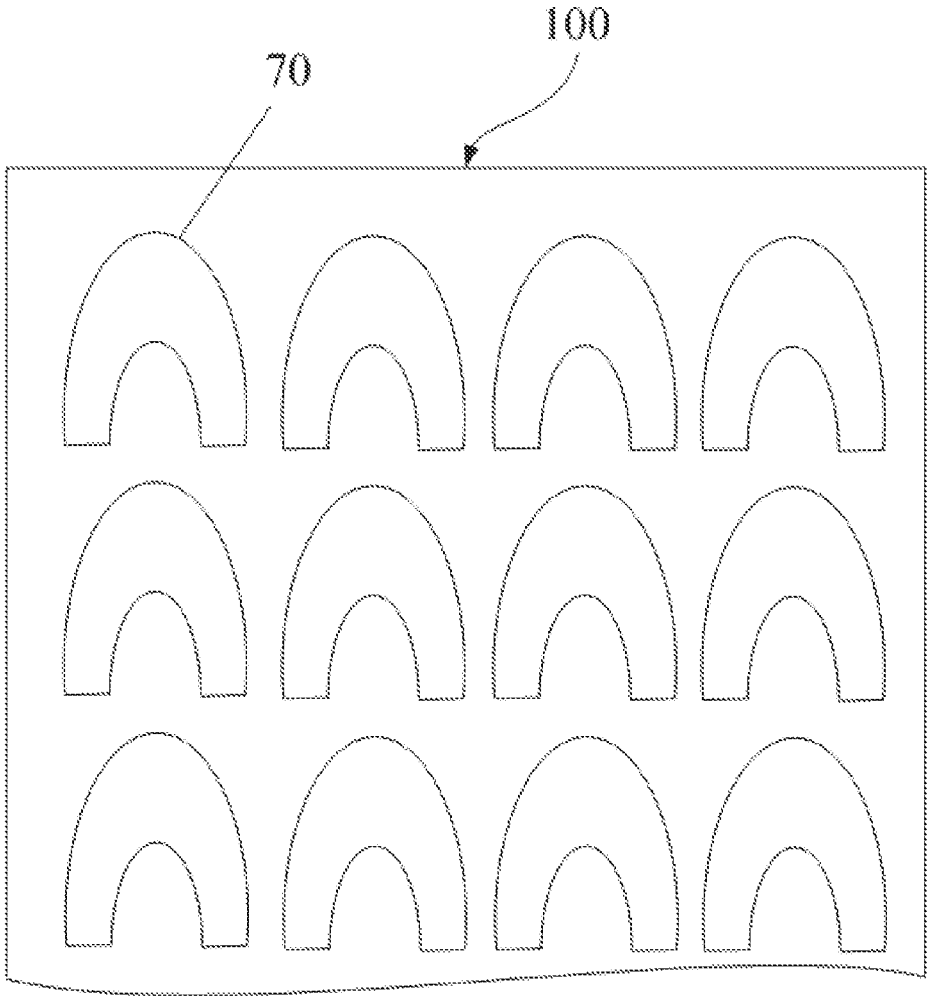
FIG. 2 is a schematic diagram of an embodiment of a functional weaving vamp fabric of the present invention.

Please refer to FIG. 1 and FIG. 2 simultaneously. A plurality of first warp units 21 and a plurality of second warp units 22 are collocated side by side, and thread diameter of the first warp units 21 is larger than that of the second warp units 22; according to weaving layout of a texture composition 70, a weft unit 31 crosses between the plurality of first warp units 21 and the plurality of second warp units 22 to produce a functional weaving vamp fabric 100 through interlacing weaving.

The present invention further collocates the first warp units 21 having thicker thread diameter closely to form a wear-resistant protrusion 61, or collocates with the second warp units 22 having thinner thread diameter to form an attractive recession 62 according to the layout of the texture composition 70 or a loose collocation; by collocating the weft unit 31 of different colors or thread diameters along with diversity of the thread diameter to demonstrate the difference of outline, the wear-resistant weaving vamp fabric with aesthetic appearance and wear-resistant is therefore wove.

For example, yarn types of the warp group and the weft group comprise monofilament yarn, elastic fiber yarn, twist yarn or combination thereof, and when the yarn type is traditional twist yarn, thread diameter of the plurality of first warp units 21 is from 300 denier to 1200 denier, thread diameter of the plurality of second warp units is from 100 denier to 450 denier, and thread diameter of the plurality of weft units is 100 denier to 1200 denier. By the texture composition 70, the weaving fabric demonstrates characteristic of three-dimensional outline on interlacing structure of thick and thin yarns.

Embodiment 2

A Functional Weaving Vamp Fabric with Elasticity and Wear-Resistant

When yarn type is changed as elastic fiber yarn and the preceding technical solution is also collocated, apart from the aforementioned wear-resistant characteristic, it can further use the elastic fiber yarn to provide adequate elongational elasticity, and by layout and collocation of the texture composition as well as the adjusted gap density of the warp units, it can avoid the fabric pattern causing tremendous deformation; furthermore, using the elastic fiber yarn can provide a better coverage by the elongational elasticity thereof, and can further maintain the integrity of the vamp pattern.

In practice, when the yarn type is elastic fiber yarn, thread diameter of the plurality of first warp units 21 is from 300 denier to 1200 denier, thread diameter of the plurality of second warp units 22 is from 100 denier to 450 denier, thread diameter of the plurality of weft units 31 is 100 denier to 1200 denier, and thread diameter of the weft unit is from 100 denier to 1200 denier.

Embodiment 3

A Weaving Vamp Fabric Having Perspectivity and Wear-Resistant Functions

When yarn type is monofilament yarn, using the strength thereof can improve the shortcomings of the traditional conjugate spinning which is lacking in enough strength. Because crispness of monofilament yarn enables to increase the proportion to the pore layout of the texture composition 70, and in practice the proportion is up to 20% to 70%; when the proportion to the pore layout is too small, the yarns shield with each other and lead to bad perspectivity; and when the proportion to the pore layout is too large, the density of the whole vamp fabric will not meet the demand; therefore, the common applied proportion is usually from 30% to 60%. Moreover, color rendering property of monofilament yarn is better that of conjugate spinning, it not only can highlight the perspectivity of vamp fabric, but also increase aesthetic thereof.

In practice, when the yarn type is monofilament yarn, thread diameter of the plurality of first warp units 21 is from 100 denier to 450 denier, thread diameter of the plurality of second warp units 22 is from 50 denier to 150 denier, and thread diameter of the plurality of weft units 31 is 50 denier to 450 denier.

The present invention further discloses a wear-resistant weaving vamp fabric having ventilation function. Comparing with the aforementioned weaving vamp fabric having wear-resistant function, it collocates a plurality of triangle heddle elements with the jacquard to conduct corresponding lifting or shifting to the warp group to interlace obliquely to form a plurality of ventilating pores, so that it has better ventilation effect to discharge hot stream and can resolve the uncomfortableness caused by foot's hot and windless.

Embodiment 4

A Weaving Vamp Fabric Having Ventilation Function

Figure 3:
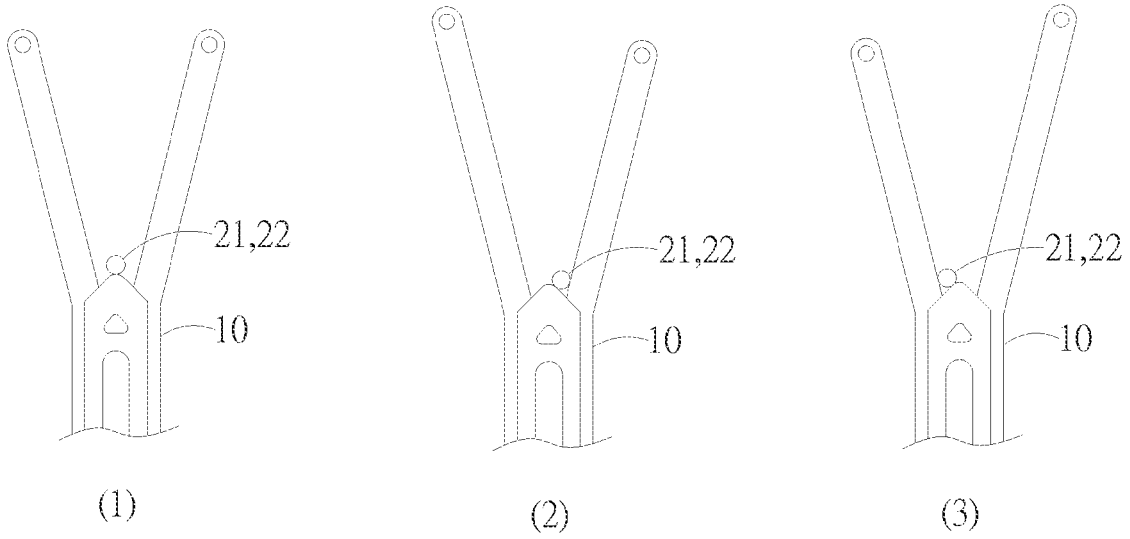
FIG. 3 is a schematic diagram of actuation of triangle heddle elements of the present invention.
Figure 4:
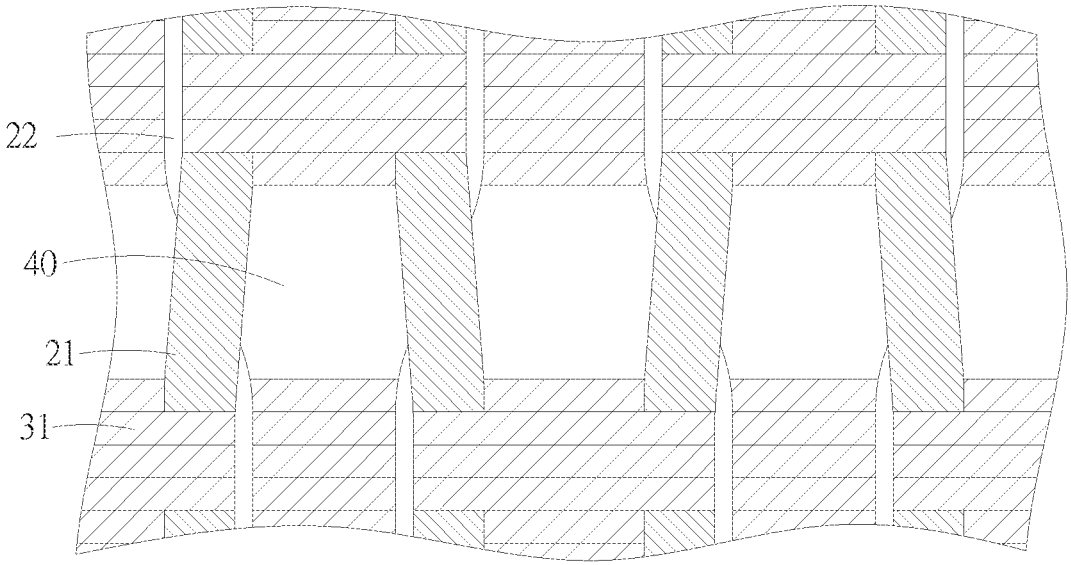
FIG. 4 is a local structural schematic diagram of a wear-resistant weaving vamp fabric having ventilation function of the present invention.

Please refer to FIG. 3 and FIG. 4 simultaneously. A triangle heddle element 10 is used to lift or shift the first warp unit 21 or the second warp unit 22. To be more precisely, when both ends of the triangle heddle element 10 rise, it lifts upwardly the corresponding warp unit; and when only one end of the triangle heddle element 10 rises, it makes the corresponding warp unit shifting oppositely to another side, enabling that the first warp unit 21 or the second warp unit 22 interlaces obliquely with the weft unit 31 to produce ventilating pores 40.

In practice, yarn types of the warp group and the weft group comprise monofilament yarn, elastic fiber yarn, twist yarn or combination thereof. When the yarn type is twist yarn, thread diameter of the plurality of first warp units 21 is from 300 denier to 1200 denier, thread diameter of the plurality of second warp units 22 is from 100 denier to 450 denier, and thread diameter of the plurality of weft units 31 is 100 denier to 1200 denier.

Embodiment 5

A Wear-Resistant Weaving Camp Fabric Having Elasticity and Ventilation Function

When yarn type is elastic fiber yarn, the triangle heddle element 10 is used to collocate with the jacquard to lift or shift the first warp unit 21 or the second warp unit 22, and because the yarn is of elongational elasticity and will cause deformation, therefore, in the manufacturing process, it has to add a torque controller to adequately adjust rolling velocity while rolling fabric roller to prevent the vamp pattern deforming so as to maintain better fabric manufacturing speed.

In practice, when the yarn type is elastic fiber yarn, thread diameter of the plurality of first warp units 21 is from 300 denier to 1200 denier, thread diameter of the plurality of second warp units 22 is from 100 denier to 450 denier, and thread diameter of the plurality of weft units is 31 100 denier to 1200 denier.

Embodiment 6

A Weaving Vamp Fabric Having Perspectivity and Wear-Resistant Functions

When yarn type is monofilament yarn, it can further maintain the ventilating pores 40 in adequate outline to increase the air-permeable property by operation of the triangle heddle element 10; moreover, water absorption of monofilament yarn is far lower than that of conjugate spinning. As a result, concerning demands for functions of perspectivity, air-permeable property, wear-resistant, easy-dry and so on, the shoes made of monofilament yarn are much better than conventional products.

In practice, when the yarn type is monofilament yarn, thread diameter of the plurality of first warp units 21 is from 100 denier to 450 denier, thread diameter of the plurality of second warp units 22 is from 50 denier to 150 denier, and thread diameter of the plurality of weft units 31 is 50 denier to 450 denier.

While the means of specific embodiments in present invention has been described by reference drawings, numerous modifications and variations could be made thereto by those skilled in the art without departing from the scope and spirit of the invention set forth in the claims. The modifications and variations should in a range limited by the specification of the present invention.

What is claimed is:

1. A weaving vamp fabric having wear-resistant function formed by a two beams jacquard according to a texture composition, the two beams jacquard comprising two warp beam yarn feed rollers, a jacquard and a plurality of weft knitting mechanisms, the texture composition comprises a pore layout, and the fabric comprising:

a warp group having a plurality of first warp units and a plurality of second warp units, the two warp beams yarn feed rollers respectively delivering the plurality of first warp units and the plurality of second warp units, and the plurality of first warp units and the plurality of second warp units respectively comprising different yarn types or thread diameters;

a weft group having a plurality of weft units, and the plurality of weft units respectively delivering the plurality of corresponding weft units;

wherein the jacquard interlaces the warp group and the weft group according to the port layout of the texture composition to form a plurality of ventilating pores, and the fabric is produced by diversity of yarn materials or thread diameters of the plurality of first warp units and the plurality of second warp units in the process of single weaving.

2. The weaving vamp fabric having wear-resistant function of claim 1, wherein yarn types of the warp group and the weft group comprise monofilament yarn, elastic fiber yarn, twist yarn or combination thereof.

3. The weaving vamp fabric having wear-resistant function of claim 2, wherein when the yarn type is monofilament yarn, thread diameter of the plurality of first warp units is from 100 denier to 450 denier, thread diameter of the plurality of second wrap units is from 50 denier to 150 denier, and thread diameter of the plurality of weft units is 50 denier to 450 denier.

4. The weaving vamp fabric having wear-resistant function of claim 2, wherein when the yarn type is elastic fiber yarn, thread diameter of the plurality of first warp units is from 300 denier to 1200 denier, thread diameter of the plurality of second wrap units is from 100 denier to 450 denier, and thread diameter of the plurality of weft units is 100 denier to 1200 denier.

5. The weaving vamp fabric having wear-resistant function of claim 2, wherein when the yarn type is twist yarn, thread diameter of the plurality of first warp units is from 300 denier to 1200 denier, thread diameter of the plurality of second wrap units is from 100 denier to 450 denier, and thread diameter of the plurality of weft units is 100 denier to 1200 denier.

6. A wear-resistant weaving vamp fabric having ventilation function formed by a two beams jacquard according to a texture composition, wherein the two beams jacquard comprises two warp beam yarn feed rollers, a jacquard, a plurality of triangle heddle elements and a plurality of weft knitting mechanisms, the texture composition comprises a pore layout, and the fabric comprises:

a warp group having a plurality of first warp units and a plurality of second wrap units, the two warp beams yarn feed rollers respectively delivering the plurality of first warp units and the plurality of second wrap units, and the plurality of first warp units and the plurality of second wrap units respectively comprising different yarn types or thread diameters;

a weft group having a plurality of weft units, and the plurality of weft units respectively delivering the plurality of corresponding weft units;

wherein the plurality of triangle heddle elements and the jacquard enable the plurality of corresponding first warp units and the plurality of second warp units lifting or shifting oppositely according to the pore layout, and collocate with the warp group to interlace obliquely to form a plurality of ventilating pores, and the fabric is produced by diversity of yarn materials or thread diameters of the plurality of first warp units and the plurality of second wrap units in the process of single weaving.

7. The weaving vamp fabric having ventilation function of claim 6, wherein yarn types of the warp group and the weft group comprise monofilament yarn, elastic fiber yarn, twist yarn or combination thereof.

8. The weaving vamp fabric having ventilation function of claim 7, wherein when the yarn type is monofilament yarn, thread diameter of the plurality of first warp units is from 100 denier to 450 denier, thread diameter of the plurality of second wrap units is from 50 denier to 150 denier, and thread diameter of the plurality of weft units is 50 denier to 450 denier.

9. The weaving vamp fabric having ventilation function of claim 7, wherein when the yarn type is elastic fiber yarn, thread diameter of the plurality of first warp units is from 300 denier to 1200 denier, thread diameter of the plurality of second wrap units is from 100 denier to 450 denier, and thread diameter of the plurality of weft units is 100 denier to 1200 denier.

10. The weaving vamp fabric having ventilation function of claim 7, wherein when the yarn type is twist yarn, thread diameter of the plurality of first warp units is from 300 denier to 1200 denier, thread diameter of the plurality of second wrap units is from 100 denier to 450 denier, and thread diameter of the plurality of weft units is 100 denier to 1200 denier.

* * * * *